United States Patent [19]

Huff

[11] 4,185,135

[45] Jan. 22, 1980

[54] METHOD FOR COATING A TEXTILE SUBSTRATE

[76] Inventor: Caswell L. Huff, Cohutta, Ga.

[21] Appl. No.: 860,242

[22] Filed: Dec. 13, 1977

[51] Int. Cl.[2] ..... B32B 3/02; B32B 30/00

[52] U.S. Cl. ..... 428/96; 427/372 B; 427/387; 427/390 D; 427/394; 428/97; 428/262; 428/447; 428/921; 260/29.6 S

[58] Field of Search ..... 428/95, 96, 97, 447, 428/920, 921, 262; 427/372, 387, 390, 394

[56] References Cited

U.S. PATENT DOCUMENTS

| | | | |
|---|---|---|---|
| 3,324,067 | 6/1967 | Donaldson | 428/96 |
| 3,854,987 | 12/1974 | Michael | 428/921 |

FOREIGN PATENT DOCUMENTS 1153299 5/1969 United Kingdom .

*Primary Examiner*—Marion E. McCamish

*Attorney, Agent, or Firm*—Schuyler, Birch, McKie & Beckett

[57] ABSTRACT

The method for coating textile substrates such as carpets and textile fabrics with a latex backing is improved by replacing up to about 40% by weight of the normally employed latex solids in the coating composition with an alkali metal silicate extender such as sodium silicate, and further adding a latex compatible metal compound which will react with the silicate extender to render the silicate values less water soluble. The improved backing layer provides a significant cost reduction, increased fire retardancy and beneficial modification of other properties of the coated substrate.

12 Claims, No Drawings

METHOD FOR COATING A TEXTILE SUBSTRATE

BACKGROUND OF THE INVENTION

1. Field of the Invention

This invention relates to a method for coating textile substrates such as carpets and textile fabrics with an improved latex-containing coating composition.

2. Description of the Prior Art

In the manufacture of coated textile substrates such as tufted carpets, a liquid coating composition containing latex normally is applied to the back of the carpet and the resulting laminate is heated in an oven to dry the backing layer and bond it to the carpet. The latex backing serves to lock the tufts into the carpet substrate, and to provide adhesions for the jute or foam layer which can be laminated to the back of the carpet. The latex backing layer also imparts to the carpet the desired hand characteristics, adds dimensional stability, adds weight to the carpet, acts to promote fire retardancy, and fills in the space between the stitches. One latex coating can comprise the total backing operation in some cases. If a secondary foam layer is applied, a latex composition similar to the undercoat composition may be employed.

Latex carpet backing compositions are presently formulated on the basis of 100 parts by weight of dry latex. Included in the standard formulations are up to 800 parts of filler. Prior art attempts to reduce the cost of these latex coating compositions in the carpet backing and fabric coating industries has almost always involved the use of increased amounts of filler. There also have been some attempts to extend (i.e., replace a portion of) the latex solids with starches, hydrocarbon oils and waxes. These prior art extenders suffer from the drawbacks of decreasing the fire retardancy of the article thus requiring increased amounts of fire retardants such as aluminum trihydrate (a filler), phosphates, borates, halogens, antimony oxidex and the like. This increase in fire retardant offsets any cost advantage from extending the latex with the prior art extenders.

Thus, it would be of great value and represent significant monetary savings if a latex extender could be found which does not adversely effect the properties of the latice including, inter alia, fire retardancy. Moreover, since most latex solids are petroleum based products, a significant reduction in utilization of these increasingly scarce materials will have an obvious beneficial impact on our natural resource picture.

SUMMARY OF THE INVENTION

It is, therefore, an object of the present invention to provide an improved method for coating a textile substrate which does not suffer from the drawbacks of the prior art.

More specifically, it is an object of the present invention to provide a method for coating textile substrates in which the latex in the coating system is extended with a low cost additive which does not adversely effect the latice properties.

It is also an object of the present invention to provide a method for coating a textile substrate in which the latex extender imparts increased flame retardancy to the article.

Another object of the present invention is to provide a method for coating a textile substrate in which the extended latex coating is more stable and can be applied to the substrate more uniformly.

It is another object of the present invention to provide an improved carpet coating method in which the adhesion strength of the dried latex coating to the carpet tufts and any secondary backing layers is as good or better than an unextended latex formulation.

Still another object of the present invention is to provide a carpet or textile article which contains an extended latex coating having the abovedescribed characteristics.

In accordance with these and other objectives the present invention comprises an improvement in the process of the steps applying a latex-based composition to a textile substrate and heating to dry the composition and bond it to the substrate, the improvement comprising formulating the latex-based composition by replacing from about 5 to about 40 parts by weight of the latex normally present in the composition based on 100 parts dry latex solids with an alkali metal silicate extender, and further adding to the composition a latex compatible metal compound which will react in situ with the silicate extender during the drying step to render the silicate extender less water soluble.

The present invention also comprises a laminated article comprising a textile substrate having bonded thereto a dried latex-based coating layer said coating layer being formed as described above.

Surprisingly, the silicate extending latex coating composition employed in the process of the present invention is more stable and better dispersed than the straight latex formulation. The pH of the latex dispersion employed in the process of the present invention is higher than that of the conventional latex system and this results in easier application and a more smooth and level coating on the carpet or textile substrate.

DESCRIPTION OF THE INVENTION

The present invention relates to a method for coating textile substrates such as carpets and textile fabrics with a latex based backing layer. While specific reference herein will be made to backings for tufted carpets, it will be recognized by one of ordinary skill in the art that the coating systems of the present invention have general utility in all types of carpet and coated textile applications.

By latex, applicant intends to refer to both natural and synthetic latexes. Included among commonly employed synthetic latexes are aqueous dispersions of polystyrene, styrene butadiene copolymer (SBR) carboxylated SBR's, neoprene, polyvinyl chloride, polyvinyl acetate, acrylonitrile copolymers, acrylic polymers and copolymers and the like.

In the formulation of a latice compound the basis is taken as 100 parts by weight of dry latex. The conventional latex latice also contains about 100–800 parts of filter. Normally these fillers comprise alumina trihydrate, which has fire retardant properties, calcium carbonate (called whiting) and clay. In addition to fillers the conventional latice also contains from about 0.5–2.0 dry parts of a thickener (e.g., sodium polyacrylate) to control viscosity and about 1 to 10 dry parts of specialty components such as soaps, color additives, stabilizers, accelerators, and the like. In the process of the invention the conventional latex, filler, thickener and specialty materials may be employed as desired.

The present invention is based on the surprising discovery that the latex component of the carpet or textile coating composition can be replaced in the conventional formulation by from about 5 to 40% by weight of an alkali metal silicate. In the extended latex formulations according to the present invention the sum of the latex and silicate extender remain 100 parts in the conventional formulation. Preferred silicate amounts are in the range of from about 15 to 25 parts by weight. Most preferred are silicate amounts of about 20 parts by weight.

The alkali metal silicates useful in the process of the present invention include the silicates of lithium, sodium, potassium, rubidium and cesium. Preferred are the silicates of sodium and potassium or mixtures thereof. Included in the sodium silicates are the "water glass" compositions which vary in formula from about $Na_2O.3.75\ SiO_2$ to $2\ Na_2O.SiO_2$. Other useful sodium silicate salts include sodium metasilicate anhydrous sodium metasilicate pentahydrate, sodium sesquisilicate, sodium orthosilicate and the like. Exemplary of similar potassium salts are $K_2Si_4O_9$, $K_2SiO_3$ and $K_2Si_2O_5$.

In the prior art the above-described silicates have been employed as fire retardants in various materials such as wall board, paper, adhesives, and latex resin systems including paints. The solubility characteristics, the high fusion temperature required and moisture regain causing loss of adhesion have taught away from the inclusion of silicates in carpet backing applications.

In addition to the silicate extender, the coating composition employed in the present invention should also contain a latex compatible metal compound which reacts with the silicate to form a less water soluble product. While not wishing to be bound by any particular theory, applicant believes that the metal compounds useful in the present invention react with soluble silicate salts to form less soluble silica gels. Any metal compound which can be incorporated in a latex system without adversely affecting the system stability or other properties, and which will react with the silicate to decrease its water solubility can be employed. Preferred are oxygen containing metal salts and metal oxides.

Among the preferred reactive metal compounds are calcium carbonate, clay, zinc oxide, trisodium phosphate and tetra sodium (or potassium) pyrophosphate. The latex-based coating composition employed in the method of the present invention can be formulated in the conventional manner by simply mixing together the ingredients (i.e., latex, extender, fillers, metal reactants, etc.) at room temperature. The silicate reactive metal compounds employed generally react very slowly, if at all, under ambient temperatures and, therefore, the inclusion of these compounds in the latex coating composition can be effected prior to the actual coating process without adversely affecting the coating composition stability. After application the latex based coating composition is dried by heating the coated substrate. During the heating step the metal compounds react with the silicate extender to render the latter less water soluble.

The amount of reactive metal compound employed depends on how reactive the compound is towards the silicate and how well the latex system will tolerate the compound. One skilled in the art can readily determine the useful range of additions for various metal compounds based on these criteria. By way of example, calcium carbonate is only moderately reactive with silicates and is relatively inert in latex systems. Therefore, amounts of about 50 to 800 parts by weight based on 100 parts latex plus silicate may be employed. Zinc oxide, on the other hand, is much more reactive and much less tolerable in latex systems. Zinc oxide additions, therefore, should be in the range of about 3 to 10 parts. Similarly, trisodium phosphate and tetra sodium (or potassium) pyrophosphate can be added in amounts of from about 3 to 10 parts. Clay is possibly one of the most reactive with silicates in the presence of heat if used in an amount of about 20 to 200 parts based on 100 parts latex plus silicate.

In the process of the present invention a coating of the aqueous extended latex dispersion described above is applied to the back of a carpet or textile substrate. This is preferably performed by conventional "lick-rolling" techniques whereby the carpet or fabric is continuously fed over a rotating applicator (lick-roller) which is rotating in a trough of latex. A doctor blade downstream from the trough scrapes or wipes the coating to the proper thickness. Any other conventional coating processes, of course, may be employed. As is customary in the carpet industry the primary back coat or precoat is preferably applied to the coat at a rate of about 18–34 ounces per square yard (dry solids).

After the precoat is applied the coated substrate is continuously forwarded to drying ovens. Drying temperatures of about 200°–375° F. are normally employed. Dryer residence time will generally depend on the weight of the backing compound applied, the type of compound applied and the dryer efficiency.

The product produced by the process of the present invention is a backed carpet or coated fabric having a portion of the latex in the coating replaced with the above-described in situ reacted silicate extender. The article containing this improved cured latex composition is significantly lower in cost and possesses strength, adhesion and fire retardancy characteristics at least as good as conventional materials. Moreover, the article produced according to the present invention exhibits better hand characteristics. In addition, the replacement of high smoke yielding hydrocarbons with the non-smoking inorganic extender of the present invention results in a safer consumer product.

The following examples are included for illustrative purposes only and are not intended to limit the scope of the invention.

EXAMPLE 1

This example shows a conventional precoat formulation normally employed to back coat a tufted carpet. The following ingredients were mixed together at room temperature in a tank equipped with an agitator.

| Ingredient | Dry Weight | % Solids | Wet Weight |
|---|---|---|---|
| Latex (carboxylated styrene butadiene) | 100 | 48.0 | 208.33 |
| Water | — | — | 126.04 |
| Whiting ($CaCO_3$) | 475 | 100 | 475.00 |
| Aluminum Hydrate ($Al_2(OH)_3$) | 75 | 100 | 75.00 |
| Thickener | 0.70 | 10 | 7.00 |
| TOTALS | 650.70 | | 891.37 |

The resulting dispersion hadia solids content of 73%, a viscosity of 60–65 cp (Brookfield RVF 5 at 20), and a weight of 14.0±.2 lbs./gal. The cost per dry pound of the formulation was $.0720.

The coating formulation was applied as a precoat to a tufted carpet back by lick rolling techniques resulting in an application rate of about 16–22 ozs./sq.yd. The coated carpet was continuously fed through a drying oven at a rate of about 25 ft./min. and a drying temperature of about 270°–285° F.

EXAMPLE 2

This example shows the process of the present invention employing a silicate extender and $CaCO_3$ as the reactive compound. The procedure of Example 1 was repeated except that the following information was employed:

| Ingredient | Dry Weight | % Solids | Wet Weight |
|---|---|---|---|
| Latex | 80 | 48 | 166.67 |
| Water | — | — | 127.70 |
| Sodium Metasilicate pentahydrate | 20 | 50 | 40.00 |
| Whiting ($CaCO_3$) | 550 | 100 | 550.00 |
| Thickener | 0.70 | 10 | 7.00 |
| TOTALS | 650.70 | | 891.37 |

The resulting dispersion had the following properties:
Solids: 73%
Viscosity: 60–65 cp.
lbs./gal.: 14±.5
Cost/dry lb.: 0.621

EXAMPLE 3

This Example shows the process of the present invention employing a silicate extender and ZnO as the reactive metal compound. The procedure of Example 1 was repeated except that the following formulation was employed:

| Ingredient | Dry Weight | % Solids | Wet Weight |
|---|---|---|---|
| Latex | 80.00 | 48 | 166.67 |
| Water | — | | 125.18 |
| Sodium Metasilicate pentahydrate | 20.00 | 50 | 40.00 |
| Zinc Oxide | 4.00 | 50 | 8.00 |
| Aluminum hydrate | 550.00 | 100 | 550.00 |
| Thickener | .70 | 10 | 7.00 |
| TOTALS | 654.70 | | 896.85 |

Properties were as follows:
Solids: 73%
Viscosity: 60–65 cp

EXAMPLE 4

This Example shows the process of the present invention employing a silicate extender and tetra sodium pyrophosphate as the reactive metal compound. The procedure of Example 1 was repeated except that the following formulation was employed:

| Ingredient | Dry Weight | % Solids | Wet Weight |
|---|---|---|---|
| Latex | 80.00 | 48 | 166.67 |
| Water | — | — | 101.81 |
| Sodium Metasilicate pentahydrate | 20.00 | 50 | 40.00 |
| TSPP | 3.00 | 100 | 30.00 |
| Aluminum hydrate | 550.00 | 10 | 55000 |

-continued

| Ingredient | Dry Weight | % Solids | Wet Weight |
|---|---|---|---|
| Thickener | .70 | | 7.00 |
| TOTALS | 653.70 | | 895.48 |

I claim:

1. In a method for coating a textile substrate with a latex-based composition comprising the steps of applying said composition to said substrate and heating to dry said composition and bond it to said substrate, the improvement comprising formulating said latex-based composition by replacing from about 5 to about 40 parts by weight of the latex normally present in said composition based on 100 parts dry latex solids with an alkali metal silicate extender, and further adding to said composition a latex compatible metal compound which will react in situ with said silicate during said drying step to render said silicate extender less water soluble.

2. The method of claim 1 wherein said silicate extender is selected from the group consisting of sodium silicate, potassium silicate and mixtures thereof.

3. The method of claim 2 wherein said silicate extender is added in an amount of from about 15 to about 25 parts based on 100 parts normally present dry latex solids.

4. The method of claim 1 wherein said metal compound is selected from the group consisting of calcium carbonate, clay, zinc oxide, trisodium phosphate, tetra sodium pyrophosphate and tetra potassium pyrophosphate.

5. The method of claim 1 wherein said textile substrate is a tufted carpet.

6. The method of claim 1 wherein said textile substrate is a fabric web.

7. A laminated article comprising a textile substrate having bonded thereto a dried latex-based coating layer, said coating layer having been applied to said substrate as an aqueous coating composition wherein said composition was formulated by replacing from about 5 to about 40 parts by weight of the latex normally present in said composition based on 100 parts dry latex solids with an alkali metal silicate extender, and further adding to said composition a latex compatible metal compound which will react in situ with said silicate during said drying step to render said silicate extender less water soluble.

8. The article of claim 7 wherein said textile substrate is a tufted carpet.

9. The artible of claim 7 wherein said textile substrate is a fabric web.

10. The article of claim 7 wherein said silicate extender is selected from the group consisting of sodium silicate, potassium silicate and mixtures thereof.

11. The article of claim 7 wherein said silicate extender is added in an amount of from about 15 to about 25 parts based on 100 parts normally present dry latex solids.

12. The articles of claim 7 wherein said metal compound is selected from the group consisting of calcium carbonate, zinc oxide, trisodium phosphate, tetra sodium pyrophosphate and tetra potassium pyrophosphate.

* * * * *